US006407493B1

(12) United States Patent
Sugawara et al.

(10) Patent No.: US 6,407,493 B1
(45) Date of Patent: Jun. 18, 2002

(54) VACUUM ENVELOPE FOR A DISPLAY DEVICE

(75) Inventors: Tsunehiko Sugawara, Chiba; Jiro Nishihama, Kanagawa; Shunichi Samejima, Tokyo, all of (JP)

(73) Assignee: Asahi Glass Company, Limited, Tokyo (JP)

( * ) Notice: Subject to any disclaimer, the term of this patent is extended or adjusted under 35 U.S.C. 154(b) by 153 days.

(21) Appl. No.: 09/634,300

(22) Filed: Aug. 9, 2000

(30) Foreign Application Priority Data

Aug. 25, 1999 (JP) ..... 11-238776

(51) Int. Cl.[7] ..... H01J 29/10
(52) U.S. Cl. ..... 313/461; 313/477 R
(58) Field of Search ..... 313/461, 473, 313/477 R, 495

(56) References Cited

U.S. PATENT DOCUMENTS 4,943,862 A 7/1990 Uesaka et al.

FOREIGN PATENT DOCUMENTS

| | | |
|---|---|---|
| EP | 0 367 269 | 5/1990 |
| EP | 0 626 717 | 11/1994 |
| GB | 1026624 | 4/1966 |

*Primary Examiner*—Vip Patel
(74) *Attorney, Agent, or Firm*—Oblon, Spivak, McClelland, Maier & Neustadt, P.C.

(57) ABSTRACT

A vacuum envelope for display which reduces a stress and a deflection in a screen area of a panel face portion and has a light weight and which is suitable for a cathode ray tube or a field emission display, wherein the screen area is composed of a complex layer member comprising a glass layer as an inner layer and a transparent resin as an outer layer, and the proportion of the Young's modulus of the transparent resin to the Young's modulus of the glass layer is 1/10–1/5.

8 Claims, 3 Drawing Sheets

VACUUM ENVELOPE FOR A DISPLAY DEVICE

The present invention relates to a vacuum envelope for a display device such as a cathode ray tube used mainly for television broadcast signal reception or an industrial equipment, or a field emission display unit (herein-below, referred to as FED).

In a conventional display device such as a cathode ray tube, FED or the like wherein phosphors are excited to emit light by utilizing a kinetic energy of electrons moving at a high speed under high vacuum condition, it was difficult to form a portion which directly contacts the inside of the vacuum envelope, with a resinous material because the resinous material is poor in hermetic properties even though it has an advantage of having a low density. It has been considered to be indispensable for a material used for the inside of the vacuum envelope to use glass from the viewpoints of a mechanical strength capable of withstanding an atmospheric pressure, X-ray absorbing properties, electrical resistance properties, heat resistance properties in manufacturing process, a risk of causing a damage by electron beams, and so on, in addition to the necessity of maintaining high vacuum condition.

In a typical cathode ray tube as shown in FIG. 3, a vacuum envelope or a glass bulb 2 is composed of a panel portion 3 for displaying an image and a funnel portion 4 including a neck portion 5 in which an electron gun 17 is housed.

In FIG. 3, reference numeral 6 designates a panel skirt portion, numeral 7 a panel face for displaying an image, numeral 8 an implosion protection reinforcing band for providing a sufficient strength, numeral 10 a sealing portion for sealing the panel portion 3 to the funnel portion 4 with a solder glass or the like, numeral 12 phosphors for emitting fluorescence by the irradiation of electron beams, numeral 13 an aluminum film which reflects the fluorescence forwardly, numeral 14 a shadow mask for landing electron beams to predetermined positions on the phosphors, and numeral 15 a stud pin for fixing the shadow mask 14 to an inner wall of the panel skirt portion 6. A character A indicates a tube axis which extends through a center line of the neck portion 5 and a center line of the panel portion 3.

The cathode ray tube is so adapted as to display an image by impinging electron beams to the phosphors at a high speed in an inner space of the vacuum envelope to excite the phosphors whereby light is emitted. Accordingly, the inside of the vacuum envelope is maintained to be high vacuum condition of about $10^{-8}$ Torr. Since the cathode ray tube has an asymmetric structure different from a spherical shape, one atmospheric pressure as a pressure difference between the inside and the outside of the vacuum envelope is applied thereto. Therefore, there is always a high deformation energy in the vacuum envelope and it is in an unstable state with respect to deformation.

If a crack is produced in the glass bulb of the A cathode ray tube in such an unstable state, a force to release an existing high deformation energy is resulted whereby the crack will develop to invite fracture. Further, in the state that a high tensile stress is loaded in an outer surface of the cathode ray tube, a delayed fracture is resulted from stress corrosion due to moisture in air, which also loses the reliability. From the above-mentioned reasons, there is a requirement to increase the thickness of a glass bulb so that a sufficient mechanical strength can be provided. As a result, for example, the weight of a glass bulb with about 29-inch screen diameter at a diagonal axis becomes to about 25 kg.

On the other hand, several kinds of image displaying devices other than cathode ray tubes have recently been proposed. It is well-known that disadvantages of the cathode ray tubes in comparison with these image-displaying devices reside mainly in that the depth and the weight of such displaying devices are large. Accordingly, attempts to shorten the depth or reduce the weight have been made.

In a conventional cathode ray tube, when the depth is shortened, a degree of asymmetry of structure of the cathode ray tube is increased, and there creates a problem that a further amount of deformation energy is accumulated in the vacuum envelope. Further, in an attempt to reduce the weight, a deformation energy is generally increased owing to reduction in the rigidity of glass. The increase of the deformation energy will increase stresses. Accordingly, reduction in safety due to fracture and reduction in reliability due to a delayed fracture are accelerated. When the wall thickness of the glass is increased in order to prevent the increase of stresses, the weight is inevitably increased.

In a typical FED as shown in FIG. 4, the vacuum envelope is basically composed of a front panel 23 made of glass for displaying an image, a rear panel 24, as a substrate for an electron emitting source, which emits electrons in an field emission mode, and an outer frame 25. Reference numeral 26 designates a cathode on which an electron emitter 27 is formed. A gate electrode 28 is formed on the rear panel 24 by interposing an insulation layer 29 so that the gate electrode controls an electron current. An anode 30 is formed on the front panel 23 and pixels 31 are formed on the anode 30 so that each pixel corresponds to each electron emitter 27. The front panel 23 and the rear panel 24 are connected with the outer frame 25 around of which is hermetically sealed with a solder glass or the like. An inner space surrounded by these members is maintained to be high vacuum condition exceeding $10^{-8}$ Torr.

Accordingly, FED should have a structure durable to an atmospheric pressure in the same manner as the cathode ray tube. Each of the wall thickness of the front panel 23 and the rear panel 24 both made of glass have to be increased in order to assure a predetermined strength. Accordingly, the weight of the vacuum envelope is fairly increased.

Heretofore, there was proposed in a publication (JP-A-8-007793) to provide a reinforcing member made of resin on an outer surface of the glass bulb in order to reduce the weight of the vacuum envelope used for a cathode ray tube, wherein the reinforcing member made of resin has a smaller density than glass. In general, the wall thickness of the panel face center of a 29-inch model glass bulb is about 14–15 mm. In the publication, however, there is description that the wall thickness of the glass panel is, for example, 7–8 mm and the thickness of polycarbonate as a reinforcing member of plastics is the same, i.e., 7–8 mm in an example. Generally, the density of the glass panel for a color cathode ray tube is about 2.8 g/cm$^3$ and the density of the polycarbonate is about 1.1 g/cm$^3$. Accordingly, a reduction of weight of about 30% can be achieved.

However, the Young's modulus of the glass panel is 7000–8000 kgf/mm$^2$ whereas the Young's modulus of polycarbonate is about 240 kgf/mm$^2$, which is about 1/30 of the Young's modulus of the glass panel. Accordingly, when a load of atmospheric pressure is applied to a vacuum envelope having the above-mentioned structure, the maximum tensile stress produced in an outer surface at an edge portion of a screen area of the glass panel of the vacuum envelope is about twice as much as the maximum tensile stress produced in a vacuum envelope of single-layered structure. Namely, when such a complex-layered structure is used, a tensile stress beyond the strength of glass in practical use is resulted from a difference in inner and outer pressures in an outer surface of the glass bulb whereby there is a possibility of causing breakage.

Further, in the case of an atmospheric pressure being applied, an amount of deflection produced in the vacuum envelope having a complex-layered structure becomes about three times as much as that produced in a vacuum envelope having a single-layered structure. As a result, correct relative positions between the positions of the phosphors and landing positions of electron beams may not be assured, whereby desirable operations for a display may not be expected. Thus, the complex-layered structure according to the conventional technique could not achieve a large reduction of the weight of the vacuum envelope while the mechanical strength of the vacuum envelope and a necessary precision for the operations of a display can be maintained in a practically usable range.

Even in FED adapted to emit electrons under high vacuum condition to excite phosphors so that light is emitted, a vacuum envelope made of glass is used in the same manner as the cathode ray tube. A publication (JPA-10-188857) proposes a technique to reduce the weight of the vacuum envelope for FED. Namely, the vacuum envelope has a structure formed by opposing two thin panels of glass with a predetermined distance; the peripheral portions of the thin panels of glass are sealed, and a sealed inner space is vacuumed, wherein a reinforcing sheet is formed integrally with a rear face of at least one of the thin panels so as to be durable to an atmospheric pressure, the reinforcing sheet being of a material having a larger Young's modulus than that of a material for the thin panels.

However, the publication describes that materials having a larger Young's modulus and a smaller density than those of glass, by which the reduction of the weight can be achieved, are ceramics such as silicon nitride, zirconia, alumina, or the like. These materials are opaque in a wave range of visible light. This means that materials having a larger Young's modulus than glass are unsuitable in terms of optics as the reinforcing member used for the screen area. On the other hand, a transparent methacrylate resin has a lower density such as about 1.2 g/cm$^3$. However, it does not provide a sufficient rigidity because the Young's modulus is small as about 260 kgf/mm$^2$. Accordingly, it is unsuitable for the reinforcing member.

It is an object of the present invention to provide a vacuum envelope for a cathode ray tube or FED, which can reduce the weight without causing a substantial increase of stress and deflection and which is safe and reliable.

In accordance with the present invention, there is provided a vacuum envelope for display which has a substantially rectangular screen area, wherein the screen area is essentially composed of a complex layer member comprising at least glass as an inner layer which contacts the exhausted inner portion and a transparent resin as an outer layer, and the proportion of the Young's modulus $E_P$ of the transparent resin to the Young's modulus $E_G$ of the glass is 1/10–1/5.

Further, according to the present invention, there is provided the vacuum envelope as described above, wherein the proportion of $E_P$ to $E_G$ is 1/10–1/7 and $\rho_P^3/E_P$ is smaller than $\rho_G^3/E_G$ where $\rho_P$ represents the density of the transparent resin and $\rho_G$ represents the density of the glass.

Figure 1:
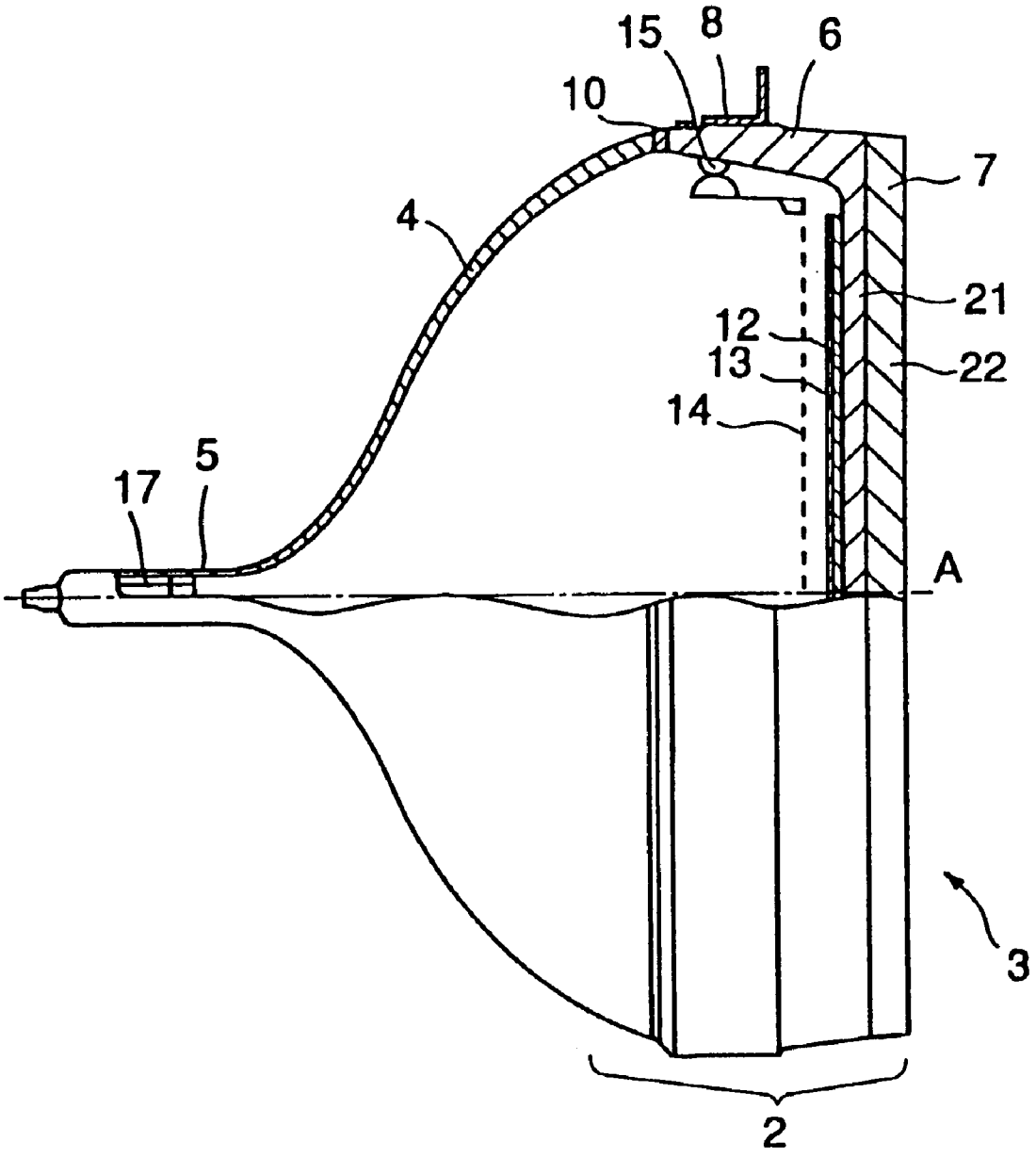
FIG. 1 is a side view partly cross-sectioned of an embodiment of the cathode ray tube according to the present invention.

Preferred embodiments of the present invention will be described in more detail with reference to the drawings.

The vacuum envelope for a display device is mainly used for a cathode ray tube or FED. A screen area of the vacuum envelope is essentially composed of a complex layer member comprising at least glass as an inner layer and a transparent resin as an outer layer.

It is important that the proportion of the Young's modulus of the transparent resin as an outer layer to the Young's modulus of the glass as an inner layer is 1/10–1/5, so that the mechanical strength of the vacuum envelope can be maintained so as to withstand sufficiently an applied load of atmospheric pressure and an amount of deflection caused by such load can be in an admissible range with respect to the operations of the device while the weight of the device can be reduced.

The Young's modulus $E_G$ of the glass used for the vacuum envelope, which varies more or less depending on the composition of the glass, is about 7000–8000 kgf/mm$^2$. If the rigidity of a vacuum envelope having a screen area composed of a complex layer member in which a transparent resin having a Young's modulus of less than 1/10 of $E_G$ is used, is made the same as the rigidity of a vacuum envelope composed of a single layer of glass, the wall thickness of the screen area is increased in order to provide a sufficient strength, hence, a weight reducing effect is poor.

On the other hand, in a vacuum envelope formed by bonding a transparent resin having a Young's modulus exceeding a value of 1/5 of $E_G$, there will cause such problem that a large stress is produced at the interface of bonding whereby the strength is reduced. Further, it is difficult to choose a transparent resinous material which provides such large Young's modulus by itself. In order to obtain a Young's modulus $E_P$ exceeding the value of 1/5 of $E_G$, it is considered to disperse a large amount of filler such as glass fibers having a high Young's modulus to compensate a reinforcing effect. However, when a large amount of filler is incorporated, uniformity in the refractive index of the resin layer is lost. Accordingly, when light produced in the vacuum envelope is passed through the resin layer, a strong dispersion is resulted owing to the ununiformity of refractive index whereby the quality of image to be displayed is inferior.

As the transparent resin as a structural element of the complex layer member, it is preferable to use a resin having a Young's modulus $E_P$ of about 800–1100 kgf/mm$^2$ at room temperature, i.e., it has a Young's modulus $E_P$ of about 1/10–1/7 of the Young's modulus $E_G$ of the glass whereby appropriate refractivity and reflectivity can be maintained. As a typical example of resin having such Young's modulus, there is a poly(paraphenylene)resin.

The transparent resin is required to increase the strength and reduce the weight effectively in association with the glass material which constitutes an inner layer of the complex layer member. In order to achieve the weight reduction, it is further desirable that $\rho_P^3/E_P$ is smaller than $\rho_G^3/E_G$ where $\rho_P$ represents the density of the transparent resin and $\rho_G$ represents the density of the glass.

As the glass for constituting the complex layer member of the vacuum envelope for a cathode ray tube in the present invention, a glass panel generally used for a cathode ray tube may be used provided that the glass panel should be thin. It is further desirable to use glass having an X-ray absorbing coefficient of 32 $cm^{-1}$ or more with respect to an X-ray having a wavelength of 0.06 nm to increase an X-ray absorbing ability in the thinned glass layer, as described in, for example, JP-A-7-206466.

It is preferred that the thickness in average of a glass layer for constituting the complex layer member in the screen area of the vacuum envelope for a cathode ray tube is 2 mm or more and is ½ or less as much as the entire thickness of the complex layer member. When the thickness is less than 2 mm, it is difficult to maintain a mechanical strength required during an assembling operation of the cathode ray tube. Since a cathode ray tube is generally operated with an accelerated voltage of 20 kV or more, electron beams impinge at a high speed substances forming the shadow mask whereby X-rays are generated. In order to absorb sufficiently the X-rays produced in the cathode ray tube by the glass of the vacuum envelope, the thickness of the glass forming the vacuum envelope is preferably 5 mm or more. On the other hand, when the thickness of the glass layer exceeds a ½ value of the entire thickness, a sufficient effect of the reduction can not be expected.

Explanation of the complex layer member of the vacuum envelope for FED of the present invention will be made. The screen area of the envelope is composed of a complex layer member comprising at least an inner layer of glass which contacts an exhausted inner space of the envelope and an outer layer of transparent resin. The glass is required to have good electrical resistance properties, electron beam withstanding properties and X-ray absorbing ability. Accordingly, use of a glass panel for a cathode ray tube, glass for plasma display, glass for an active matrix type liquid crystal or the like is preferred.

It is preferable that the thickness of the glass layer of the complex layer member of the vacuum envelope for FED is 0.7 mm or more and is not more than ½ of the entire thickness of the complex layer member. When the thickness is less than 0.7 mm, it is difficult to maintain a mechanical strength required during an assembling operation of FED. Further, since a high voltage actuation type FED generally uses an accelerated voltage of several kV or more, X-rays are produced by accelerated electron beams in the same manner as in the cathode ray tube. In order to absorb sufficiently the X-rays produced in FED by the glass constituting the vacuum envelope, the thickness of the glass forming the vacuum envelope is preferably 2 mm or more. On the other hand, when the thickness of the glass layer is larger than a value of ½ of the entire thickness of the complex layer member, a sufficient effect of reducing the weight can not be expected even though a sufficient rigidity can be maintained.

In the present invention, the glass and the transparent resin are fixed to each other by bonding thereby forming a complex layer. The refractive index of a bonding agent used for bonding is selected in considering the refractive indices of the glass layer and the transparent resin so as not to invite an unnecessary increase of a reflectivity of outer light. It is preferable that the bonding agent has transparency, electrical conductivity and a high X-ray absorbing ability to a visible light.

The complex layer member for a vacuum envelope according to the present invention can be used for a portion including a screen area such as a panel portion of a cathode ray tube or the entirety of a front panel of FED, or another portion. Generally, the complex layer member is composed of two layers; a glass layer and a transparent resin layer. However, an intermediate layer capable of adjusting a difference of expansion of these elements may be interposed between them so that the complex layer member has a structure of three layers or more. Further, an outermost layer for reducing a reflectivity of outer light may be formed on an outer surface of the transparent resin layer by using a surface treatment such as sputtering whereby visibility can be increased.

In the present invention, the structure of the complex layer member which is essentially composed of a glass layer as an inner layer and a transparent resin layer as an outer layer includes the above-mentioned structure. It is desirable that the layer formed by a surface treatment has light absorbing properties, electrical conductivity and a high X-ray absorbing ability.

Further, the total transmissivity of the complex layer member, determined by taking account of the transmissivity of each of the glass layer, the bonding layer, the transparent resin layer and the surface treatment layer, is preferably 20% or more. It is further preferable that the total transmissivity is 30–70% from the viewpoint of rendering a contrast obtainable from the comparison of a strength of light, produced mu inside of the display device, at the display surface of it with a reflectivity of outer light to be an appropriate range.

Deformation caused in a vacuum envelope having a substantially flat screen area by an atmospheric pressure is mainly a bending deformation. The bending deformation in a flat sheet is in proportion to a load applied from the outside and is in inverse proportion to a bending rigidity of the flat sheet. The bending rigidity (Young's modulus × a secondary moment to a cross-sectioned area) is in proportion to the third power of the thickness of a sheet material and is in inverse proportion to Young's modulus where the sheet material is of a single sheet.

On the other hand, let us assume that a sheet having a high Young's modulus and a high density and a sheet having a low Young's modulus and a low density are laminated. In this case, the bending rigidity can be increased when the thickness of the sheet having a high Young's modulus is thin because the sheet is apart from the center of bending. Thus, the laminated sheets can reduce an amount of deflection in comparison with a single sheet by optimizing a combination of the thicknesses of the laminated sheets, and accordingly, the weight of the vacuum envelope can be reduced. For example, when a resin having a density of about ½ of the glass and a Young's modulus of about ⅛–⅐ of the glass is used to form a complex layer member, a weight reduction of 20–30% can be achieved.

However, when the Young's modulus of the resin is too low, a reduction rate of weight is decreased. A generally used polycarbonate or polymethylmethacrylate has a low rigidity such as about 1/30 of glass, and $\rho_P^3/E_P$ being larger than $\rho_G^3/E_G$. In order that the rigidity of a vacuum envelope comprising glass solely is the same as the rigidity of a vacuum envelope comprising a complex layer member with such resin, it is necessary to increase the thickness of the resin so that it has a sufficient rigidity. As a result, the effect of reducing the weight is little or not at all.

A bending stress which controls directly the strength is in proportion to a load and is in inverse proportion to the second power of the thickness of a sheet where the sheet is a single sheet. A stress produced in a complex layer member, which is more complicated, is generally in proportion to an amount of deflection and a thickness of the complex layer member. Accordingly, even though the bending stress is made the same as that of the single sheet, the reduction of the weight can be achieved in comparison with a case of using the single sheet in the same manner as described about the bending deformation.

EXAMPLE

Example 1

Figure 3:
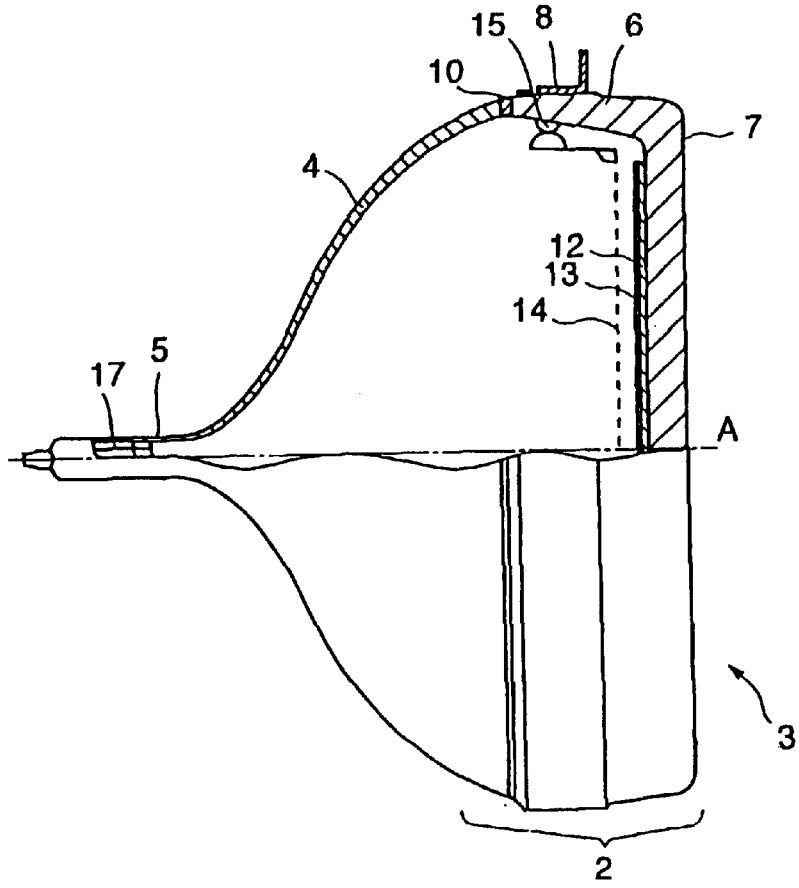
FIG. 3 is a side view partly cross-sectioned of a cathode ray tube according to a conventional technique.
Figure 4:
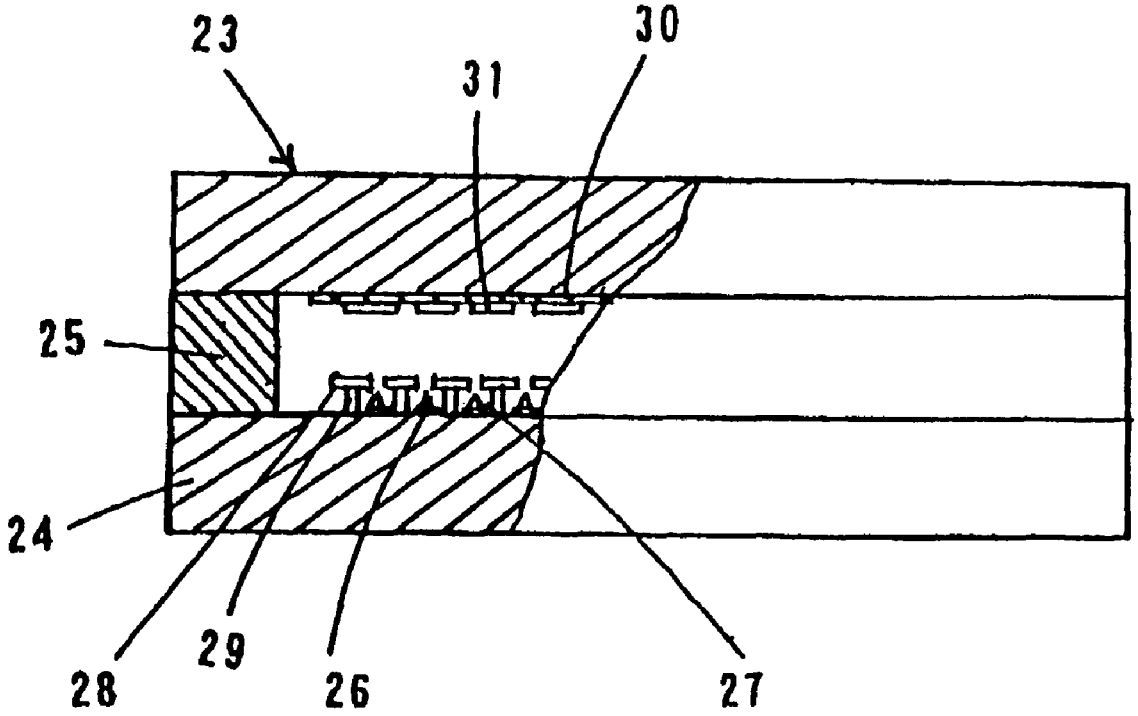
FIG. 4 is a plan view partly cross-sectioned of FED according to a conventional technique.

FIG. 1 shows a construction of the cathode ray tube having a complex-layered structure according to the present invention. The basic construction of the cathode ray tube is the same as that of the conventional cathode ray tube shown in FIG. 3. A vacuum envelope 2 is composed of a panel 3 for displaying an image and a funnel 4. A panel face 7 on which an image is shown is composed of a glass layer 21 as an inner layer and a transparent resin layer 22 as an outer layer. The cathode ray tube is of a 29-inch type having a substantially rectangular flat face portion wherein the aspect ratio of a screen portion is 3:4.

In this example, the panel 3 and the funnel 4 are products by Asahi Glass Company, Limited and have physical values as shown in Table 1. As the outer transparent resin layer as an a constituent element of the panel 3, Parmax (registered trademark) manufactured by Maxdem in U.S.A. is used. Parmax is a poly(paraphenylene) resin having properties such as a glass transition temperature of 160° C., a density of 1.2 g/cm$^3$ and a Young's modulus of 1050 kgf/mm$^2$. A face portion of the panel 3 has a two-layered structure formed by bonding the transparent resin layer 22 to the glass layer 21 wherein the thickness of the glass layer 21 is 5 mm, the thickness of the transparent resin layer 22 is 14 mm and the entire thickness of the panel face 7 is 19 mm.

Since an atmospheric pressure is applied to an outer surface of the cathode ray tube, a bending moment is produced and a large tensile stress is applied to an edge of an effective screen area on a short axis of the face. The tensile stress was 10 MPa in an outer surface portion of the glass layer and 4 MPa in an outer surface portion of the transparent resin. The amount of deflection in a central portion of the face portion was 0.7 mm. In comparing the cathode ray tube of Comparative Example 1 (Table 2) which has a panel face 7 comprising a single layer of glass with the cathode ray tube of Example 1, the thickness of the panel face 7 of Comparative Example 1 was 16 mm in order to provide the same tensile stress as the panel face of Example 1. As a result, Example 1 could achieve a weight reduction effect of about 30% in comparison with the cathode ray tube comprising a single layer of glass.

Table 2 also shows Comparative Example 2 having a complex-layered structure comprising, as a resin layer, polycarbonate having a smaller Young's modulus. In Comparative Example 2, the thickness of the glass layer was 8 mm and the thickness of the polycarbonate was 20 mm. However, the weight was substantially the same as the case comprising a single layer of glass and an effective weight reduction could not be obtained although the maximum tensile stress was increased to 11 MPa in comparison with Example 1 and Comparative Example 1.

$\rho^3/E$ ($\rho$ represents density and E represents Young's modulus) of the materials used were as follows. Glass : 0.0028, Parmax : 0.0016, and polycarbonate 0.0055.

Example 2

Figure 2:
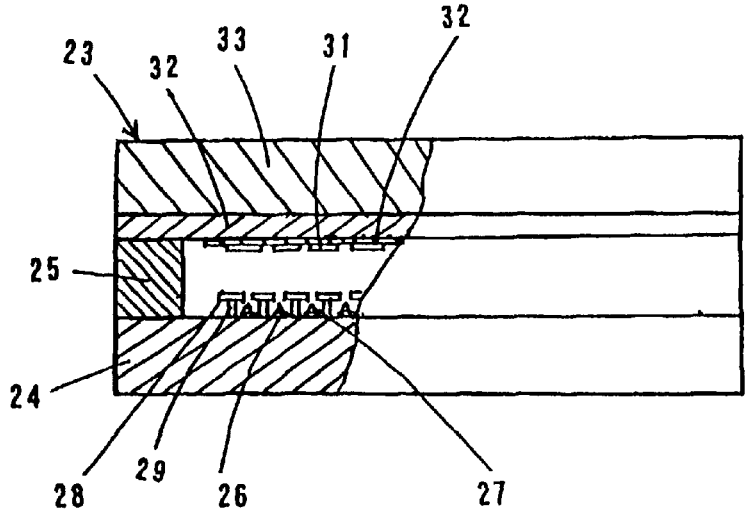
FIG. 2 is a plan view partly cross-sectioned of an embodiment of FED according to the present invention.

FIG. 2 shows a construction of FED which uses the complex-layered structure of the present invention. FED of this example is of a 15-inch type FED having a substantially rectangular area wherein the aspect ratio of a screen portion is 3:4. A vacuum envelope is basically composed of a front panel 23 for displaying an image, a rear panel 24, as a substrate for an electron emitting source, which emits electrons in a field emission mode, and an outer frame 53.

The front panel 23 has a two-layered structure comprising a glass layer 32 as an inner layer and a transparent resin layer 33 as an outer layer. The front panel 23 and the rear panel 24 are sealed with a solder glass or the like by interposing the outer frame 25 so as to provide a hermetic condition. The inner space of the vacuum envelope is maintained in high vacuum condition exceeding $10^{-8}$ Torr. Cathodes 26 are arranged on the rear panel 24 in the inner space of the envelope and an electron emitter 27 is formed on each of the cathodes 26. Gate electrodes 28 are also formed on the rear panel 24 by interposing insulating layers 29 so that electron currents can be controlled. On the other hand, pixels of fluorescence 31 are provided on the front panel 23 by interposing an anode 30 so as to oppose the electron emitter 27.

In Example 2, glass materials having the physical properties as shown in Table 1 are used as the front panel 23, the rear panel 24 and the outer frame 25. As the transparent resin 33 as an outer layer for constituting the front panel 23, Parmax manufactured by Maxdem in U.S.A. is used in the same manner as in Example 1. The front panel 23 has a two-layered structure formed by bonding the transparent resin 33 to the glass 32 wherein the thickness of the glass 32 is 3 mm, the thickness of the transparent resin 33 is 18 mm, and the entire thickness of the front panel 23 is 21 mm.

Since an atmospheric pressure is applied to an outer surface of FED in the same manner as the cathode ray tube, a bending moment is produced and a large tensile stress is applied to an edge of an effective screen area on a short axis of the front panel 23. The tensile stress was 7 MPa in an outer surface portion of the glass layer. The amount of deflection in a central portion of the front panel 23 was 50 $\mu$m. For comparison, the thickness of the front panel 23 of FED comprising a single layer of glass which provides the same amount of deflection as in FED comprising the complex layer member was measured. As a result, the thickness was 14 mm. Further, the maximum tensile stress produced in an edge portion of the effective face on a short axis was 8 MPa. Namely, Example 2 could achieve a weight reduction of about 25% in comparison with the cathode ray tube comprising a single layer of glass while the maximum tensile stress produced in an edge portion of an effective face on a short axis can be reduced.

TABLE 1

| Title | Panel | Glass funnel | Front panel |
|---|---|---|---|
| Density (g/cm$^3$) | 2.78 | 3.00 | 2.77 |
| Young's modulus (kgf/mm$^2$) | 7500 | 6900 | 7800 |
| Poisson's ratio | 0.21 | 0.21 | 0.21 |
| X-ray absorbing coefficient (cm$^{-1}$) | 28 | 65 | 19 |

TABLE 2

| | Example 1 | Comparative Example 1 | Comparative Example 2 |
|---|---|---|---|
| Face structure | Two layers | Single layer of glass | Two layers |
| Glass thickness (mm) | 5 | 16 | 8 |

TABLE 2-continued

| | Example 1 | Comparative Example 1 | Comparative Example 2 |
|---|---|---|---|
| Resin material | Parmax | — | Poly carbonate |
| Resin thickness (mm) | 14 | — | 20 |
| Deflection (mm) | 0.7 | 0.5 | 0.8 |
| Maximum tensile stress (MPa) | 10 | 10 | 11 |
| Weight of effective image-displaying portion (kg) | 8.9 | 12.8 | 12.7 |

In accordance with the present invention, a safe and highly reliable vacuum envelope for display can be provided without causing a substantial increase of stress and deflection, and the weight of the vacuum envelope can be reduced.

What is claimed is:

1. A vacuum envelope for display which has a substantially rectangular picture displaying region, wherein the picture displaying region is essentially composed of a complex layer member comprising at least glass as an inner layer which contacts an exhausted inner portion and a transparent resin as an outer layer, and the proportion of the Young's modulus $E_P$ of the transparent resin to the Young's modulus $E_G$ of the glass is 1/10–1/5.

2. The vacuum envelope for display according to claim 1, wherein the proportion of $E_P$ to $E_G$ is 1/10–1/7.

3. The vacuum envelope for display according to claim 1, wherein $\rho_P^3/E_P$ is smaller than $\rho_G^3/E_G$ where $\rho_P$ represents the density of the transparent resin and $\rho_G$ represents the density of the glass.

4. The vacuum envelope for display according to claim 1, wherein the proportion of $E_P$ to $E_G$ is 1/10–1/7 and $\rho_P^3/E_P$ is smaller than $\rho_G^3/E_G$ where $\rho_P$ represents the density of the transparent resin and $\rho_G$ represents the density of the glass.

5. The vacuum envelope for display according to claim 1, wherein the glass as an inner layer is fixed by bonding to the transparent resin as an outer layer.

6. The vacuum envelope for display according to claim 1, wherein the thickness of the glass as a constituent element of the complex layer member is 2 mm or more and is not more than ½ of the entire thickness of the complex layer member.

7. The vacuum envelope for display according to claim 1, wherein the vacuum envelope is used for a field emission display, and the thickness of the glass as a constituent element of the complex layer member is 0.7 mm or more and is not more than ½ of the entire thickness of the complex layer member.

8. The vacuum envelope for display according to claim 1, wherein the transparent resin is a poly (paraphenylene) resin.

* * * * *